United States Patent [19]

Visser

[11] 3,945,673

[45] Mar. 23, 1976

[54] LOAD ENGAGING AND SUPPORTING MECHANISM

[75] Inventor: Peter J. Visser, Niles, Mich.

[73] Assignee: Clark Equipment Company, Buchanan, Mich.

[22] Filed: Feb. 25, 1974

[21] Appl. No.: 445,800

Related U.S. Application Data

[60] Division of Ser. No. 318,512, Dec. 26, 1972, abandoned, which is a continuation-in-part of Ser. No. 267,747, June 30, 1972, Pat. No. 3,827,743.

[52] U.S. Cl. ..... 294/67 DA; 294/81 SF

[51] Int. Cl.[2] ..... B66C 1/66

[58] Field of Search..... 294/81 R, 81 SF, 67 R, 294/67 BB, 67 BC, 67 D, 67 DA, 67 DB; 24/211 K, 211 L, 221 R; 105/366 B, 366 C, 366 D, 366 E, 464; 214/77 R, 621; 248/119 R; 292/74, 109, 137

[56] References Cited

UNITED STATES PATENTS

| | | | |
|---|---|---|---|
| 3,243,224 | 3/1966 | Gutridge | 294/81 SF X |
| 3,296,981 | 1/1967 | Bergstrand | 248/119 R X |
| 3,387,729 | 6/1968 | Hindin et al. | 294/67 R X |
| 3,448,874 | 6/1969 | Martinson | 214/77 R X |
| 3,458,229 | 7/1969 | Nagy et al. | 294/81 SF |
| 3,495,726 | 2/1970 | Goldhofer | 214/77 R |
| 3,513,997 | 5/1970 | Heyer et al. | 294/67 R X |
| 3,688,933 | 9/1972 | Rumell | 294/67 D X |

*Primary Examiner*—John J. Love
*Assistant Examiner*—Johnny D. Cherry
*Attorney, Agent, or Firm*—Marmaduke Hobbs

[57] ABSTRACT

A load engaging and supporting mechanism for use with load handling equipment, in which a beam is movable to a position over a container, and a pair of carriages are adjustable along the beam and have arms extending downwardly along each side for lifting and moving the container. A load engaging mechanism is disposed in each of said arms and contains a pin adapted to extend into openings in fixtures in the upper side corners of the container as the two arms of each carriage are moved toward one another. A positioning structure is preferably provided with each fitting to assist in locating the fitting in the fixture. The present fitting may be included in the equipment along with other types of load engaging and lifting mechanisms, and is preferably retractable to prevent it from interfering with the operation of the alternative mechanism.

7 Claims, 13 Drawing Figures

LOAD ENGAGING AND SUPPORTING MECHANISM

This application is a division of copending application Ser. No. 318,512 filed Dec. 26, 1972, now abandoned, which in turn was a continuation-in-part of my copending application Ser. No. 267,747, filed June 30, 1972, now U.S. Pat. No. 3,827,743.

In equipment for transferring loads such as semi-trailers and cargo containers onto and from railroad cars, the load is normally lifted and moved by a beam or boom having a grappling means which engages fixtures in the upper four corners of the load, or which slips beneath the lower edges of the load and supports the load while it is being lifted and transferred either to or from the railroad car. These prior grappling means have usually consisted of a unitary frame structure often supported on the beam or boom by cables and having arms extending downwardly along the sides of the container with lift shoes at the bottom for engaging the underside of the load. These frame structures have generally been bulky and cumbersome to operate and have often required the load transfer equipment to be substantially larger than the load in order to accommodate the frame structure and to provide space for manipulating it into its load lifting and transfer positions. Further, the devices for engaging the fixtures on the containers have frequently been difficult to adjust to different site loads and to position at the proper location for engaging the fixtures, and have been either difficult to latch and/or unreliable while supporting the load. It is therefore one of the principal objects of the present invention to provide a beam mounted load engaging and supporting mechanism which can readily and effectively be adjusted both lengthwise and crosswise to the dimensions of a semitrailer or container, and which requires little additional operating space beyond that required for the operation of the beam.

Another object of the invention is to provide a load engaging mechanism which can be used in conjunction with and as an alternative for the type having the vertical arms with shoes at the bottom for supporting the load, without removing operational parts of the other, and which can be easily and quickly attached to the load without the use of tools or other equipment apart from the mechanism itself.

Still another object of the invention is to provide a rather simple and compact load engaging mechanism which can be coupled to the load and controlled by an operator at a location remote from the load without any manual manipulation of the load engaging fixtures, to either attach them to or detach them from the load, and which operates as a part of a load supporting beam normally positioned longitudinally with respect to the load such as a semitrailer or cargo container.

Further objects and advantages of the invention will become apparent from the following description and accompanying drawings, wherein.

Figure 1:
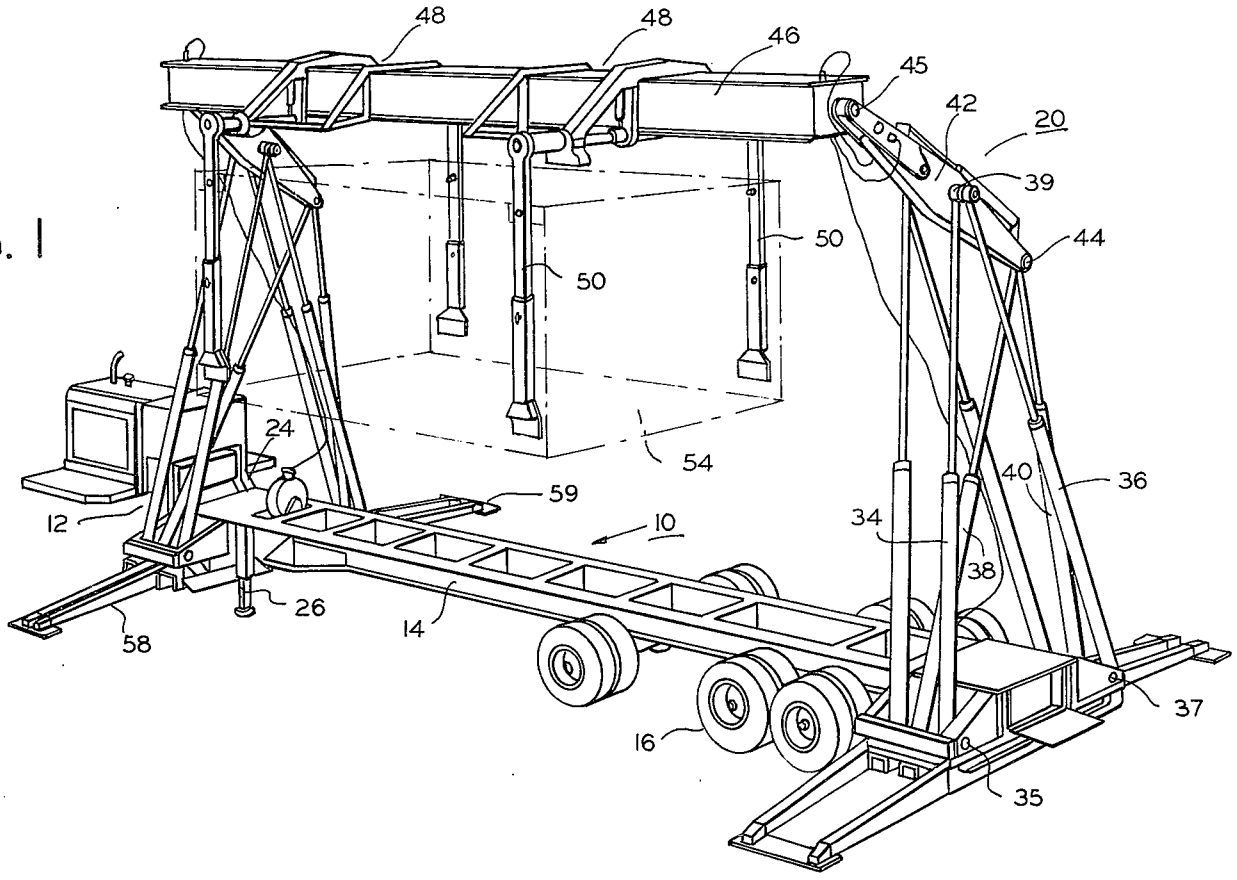
FIG. 1 is a perspective view of a load transfer mechanism on which the present load engaging and lifting mechanism is used.

Referring more specifically to the drawings, numeral 10 indicates a semitrailer adapted to be connected to a tractor at the forward end 12 by a kingpin, the bed 14 of the trailer being supported on an undercarriage 16. The present mechanism, which is indicated generally by numeral 20, is mounted on and secured to the bed and is transported along with the semitrailer from one operational location to another without any substantial changes in the structure between operating position and transporting position. The semitrailer may be of conventional construction or it may be specifically designed for use in conjunction with the present load transfer mechanism, the one shown having a gooseneck portion 24 and a landing gear 26 disposed on each side of bed 14. While the structure interconnecting the forward end and the undercarriage is here referred to as a bed or base, it may be a beam or frame type structure other than that normally considered as a bed. While the load transfer mechanism is shown mounted on a semitrailer, it can be mounted on a stationary base if desired, and the cargo containers or trailers to be loaded and unloaded may be brought to that position instead of transporting the load transfer device to the railroad car or other location where the load is to be moved by the mechanism. A load transfer mechanism of the type involved in the present application is shown and claimed in my copending application Ser. No. 187,362 filed Oct. 7, 1971, now U.S. Pat. No. 3,718,221.

Referring further to FIG. 1, the numerals 34 and 36 designate, respectively, a pair of extensible and retractable main actuators or cylinders pivoted on the frame of bed 14 at their lower end about axes 35 and 37. Actually, both actuators 34 and 36 comprise two actuators in the embodiment described and illustrated herein, and the arrangement just described is duplicated at the opposite end of the base 14. In order to simplify the description of the invention, the main actuators 34 and 36 will be referred to as if they were each single actuators instead of double. There is also a pair of boom or auxiliary actuators indicated, respectively, by the numerals 38 and 40, the lower end of actuator 38 being pivoted about the same axis as main actuator 34 in the embodiment illustrated, and the lower end of actuator 40 being pivoted about the same axis as main actuator 36. The auxiliary actuators are duplicated at the opposite end of the bed in the form of the load transfer mechanism illustrated, as may be seen in FIG. 1. The main and auxiliary actuators are illustrated herein as hydraulic cylinder and piston type expansible chamber devices, preferably of the type disclosed and claimed in my copending application Ser. No. 211,523, filed Dec. 23, 1971, now U.S. Pat. No. 3,824,904.

The upper ends of the main actuators 34 and 36 at both ends of the load transfer mechanism are pivotally connected at an intermediate location 39 to a transverse boom arm 42, and the upper ends of the auxiliary actuators 38 and 40 are pivotally connected about a common shaft 44 adjacent one end of the boom arm, this arrangement likewise applying to the other end of the mechanism. The other end of each boom arm, i.e., the free end thereof, in the embodiment shown, supports between the arms a spreader beam and lifting device, pivotable about a pivot axis 45. The lifting device includes a beam 46, which supports depending container engaging means indicated generally by numeral 48, having arms 50 and including the present load engaging and supporting means, to be more fully described hereinafter.

The two container engaging means 48 are adjusted to the width of the load, and also are moved longitudinally on the main longitudinal member 46 in order to adjust to the length of the load. FIG. 1 shows the load transfer mechanism as it is beginning to transfer cargo container 54 between a railraod car on one side of the load transfer mechanism and the ground on the other. The auxiliary actuators 40 and 38 are contracted, thereby lowering the right ends of boom arms 42, one at each end of the mechanism, and raising the left ends of such boom arms and lifting along therewith container 54 off the railroad car. Outriggers 58 and 59 are provided on the sides of the portable load transfer mechanism in order to stabilize it during the handling of a heavy load from one side to the other, one suitable type of outriggers being disclosed and claimed in my copending application Ser. No. 221,967 filed Jan. 31, 1972, now U.S. Pat. No. 3,743,108.

Figure 2:
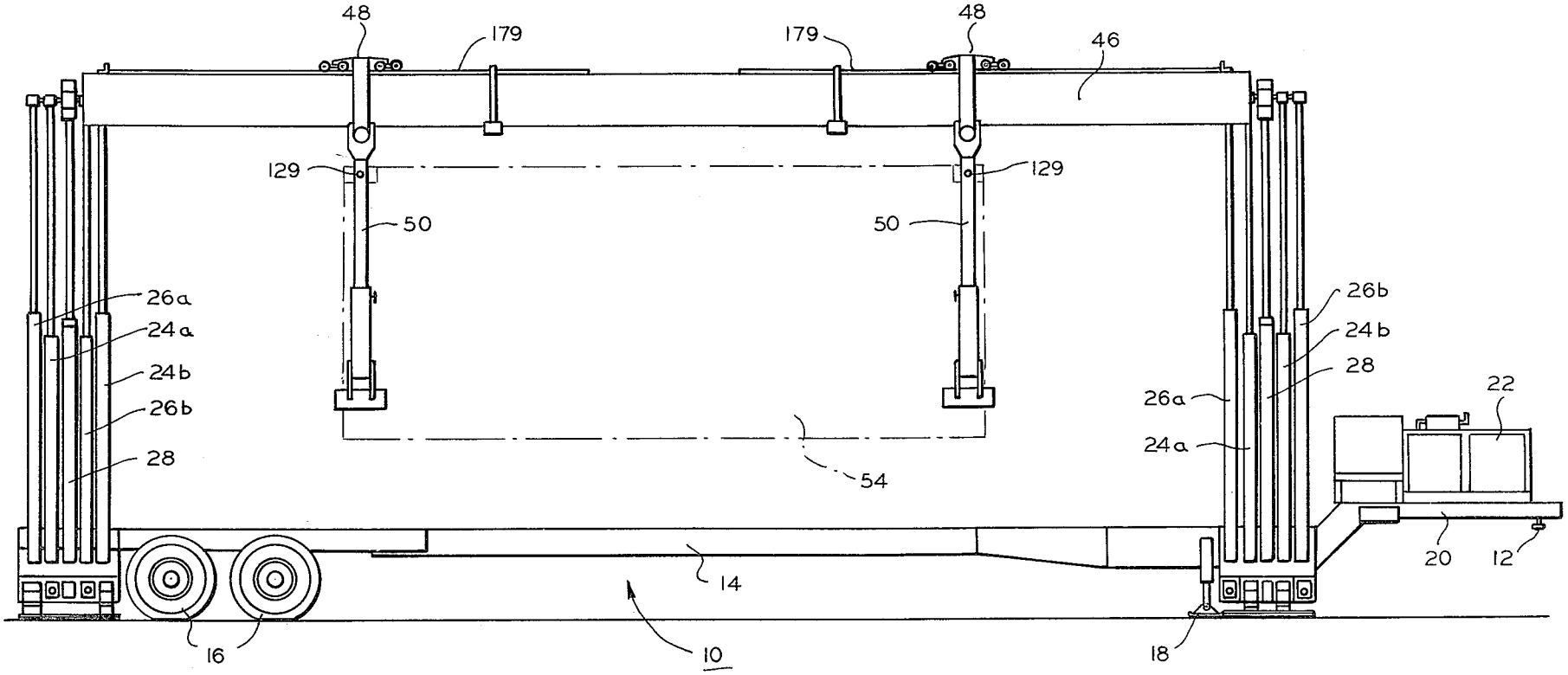
FIG. 2 is a side elevation of the load transfer mechanism with the load handling apparatus, showing a cargo container in broken lines supported thereby.
Figure 3:
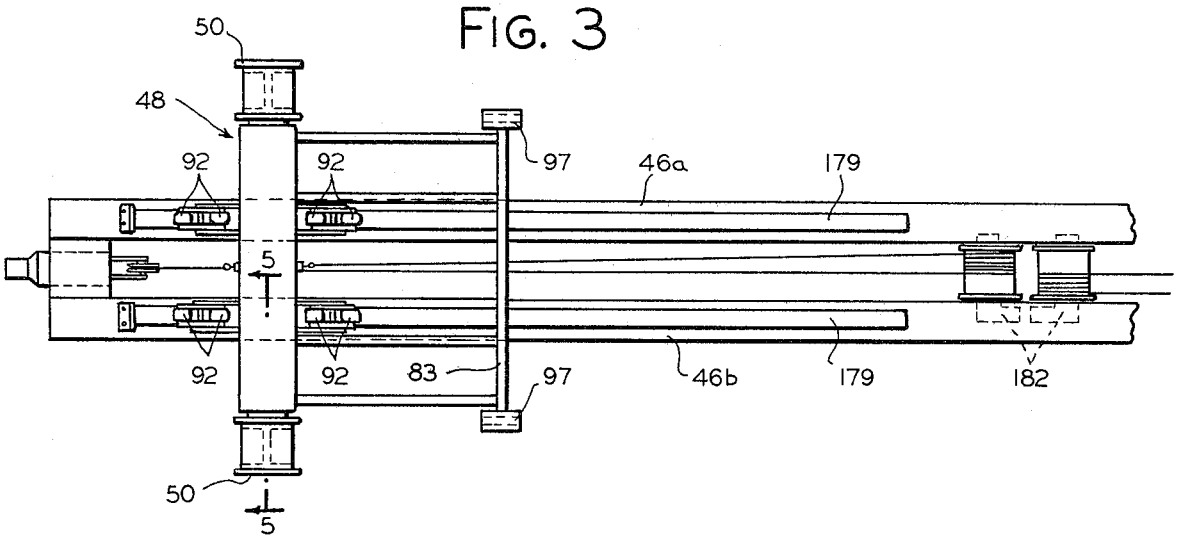
FIG. 3 is a top plan view showing a portion of the load handling apparatus.
Figure 4:
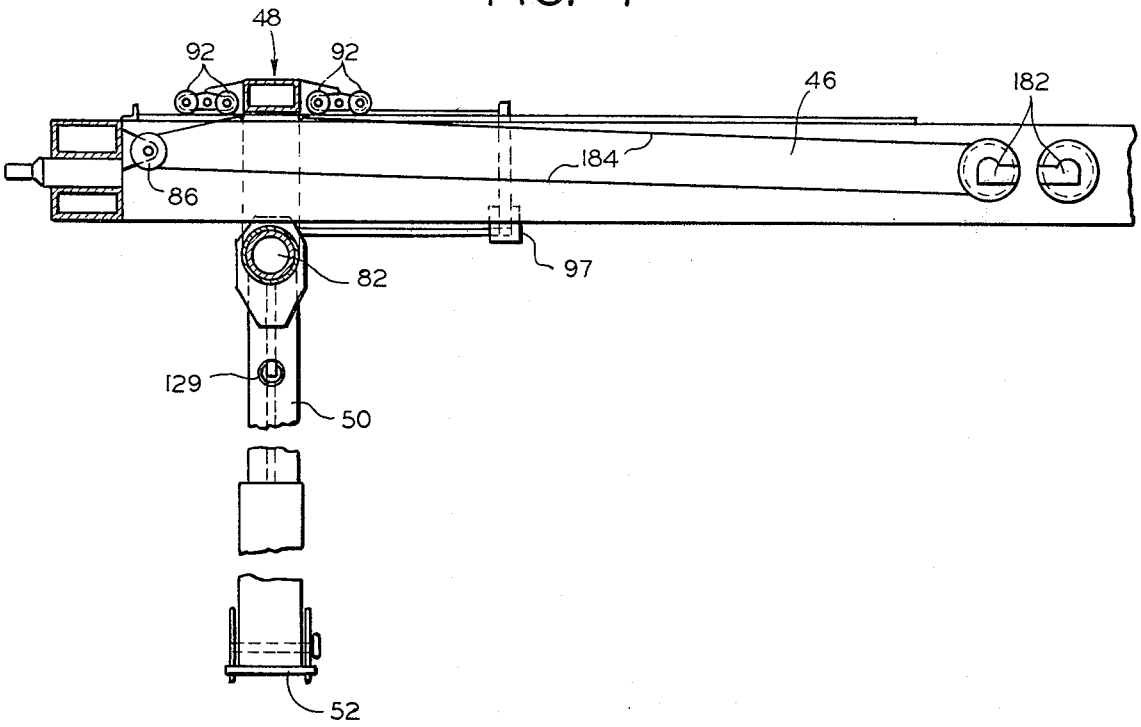
FIG. 4 is a side elevational view showing the same portion as FIG. 3 of the load handling apparatus.

As shown in FIG. 2, the load handling device includes carriages 48 which are adjustable longitudinally along the main beam 46 and this is illustrated in more detail by the partially schematic top plan and side elevational view of FIGS. 3 and 4, it being understood that the carriage 48 at the opposite end of the machine is an allochiral image of the structure to be described. Main beam structure 46 is indicated in FIG. 3 as comprising two I-beams which are designated respectively **46*a* and 46*b*. Each carriage 48 is supported on rollers 92 which operate on tracks 179 on the upper surfaces of I-beams 46*a* and 46*b*, and the carriage 48 is moved back and forth longitudinally along the beam 46 by means of a known mechanism including a hydraulic motor at 182 which operates suitable cables 184, one of which is trained over sheave 86, to provide forward and reverse movement of the carriage 48, powered by motor 182** in a known manner.

Figure 5A:
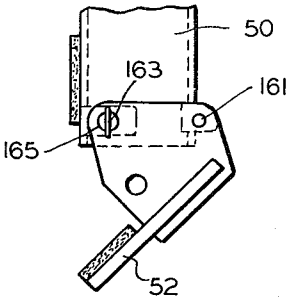
FIG. 5A is a fragmentary view of the shoe portion of FIG. 4 showing the shoe in its retracted position.
Figure 5:
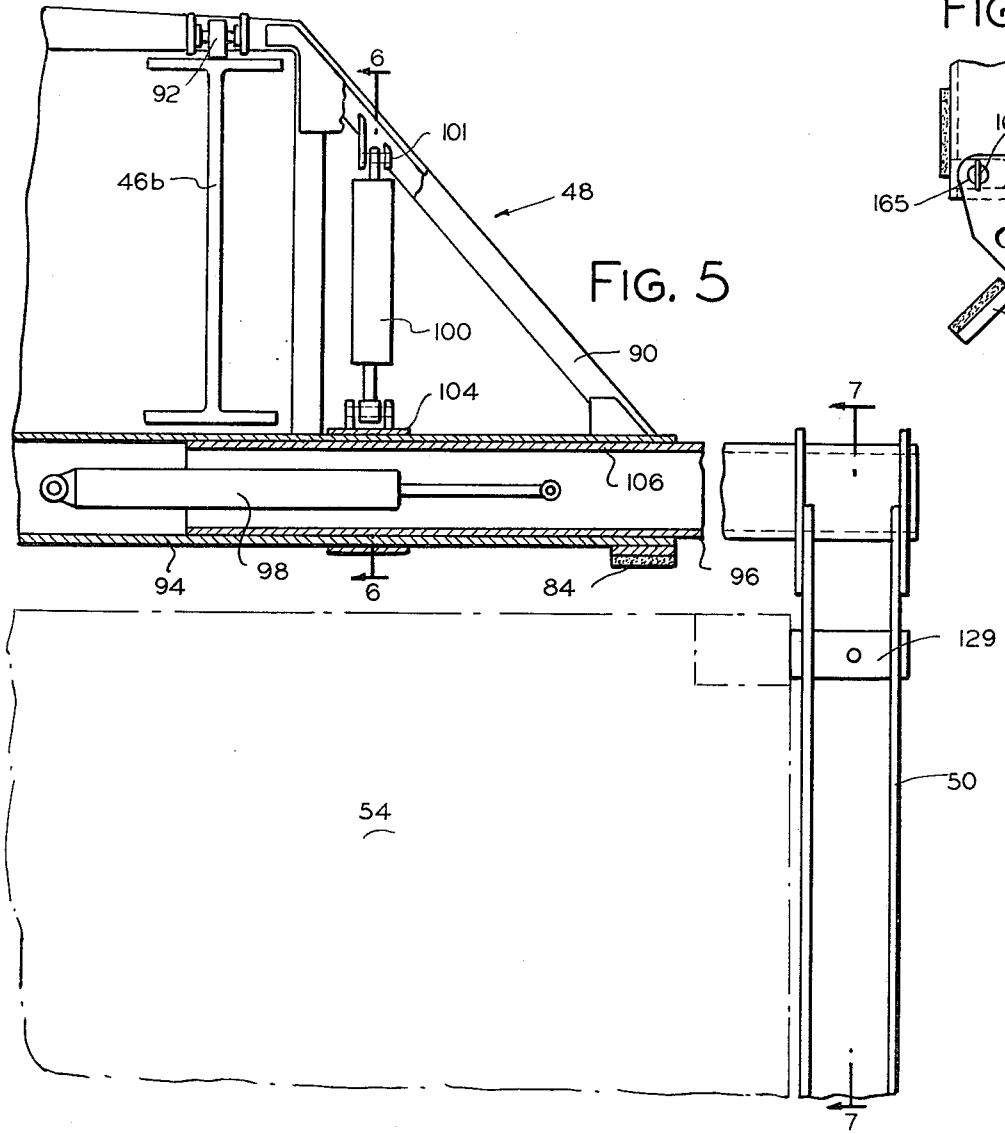
FIG. 5 is an enlarged fragmentary sectional view taken on line 5 — 5 of FIG. 3.

FIGS. 2–9 illustrate the details of one embodiment of the load handling apparatus and the manner of operation to pick up a load. Each device includes a pair of lift arms 50 which are secured respectively at the ends of tubular members 96 and which have shoes 52 at their lower ends (see FIG. 5A). Each of the lift arms 50 is pivotable by remote control from the solid line position shown in FIG. 4, which represents the operating position. In the collapsed or transport position, the arms 50 are rotated up and secured to brackets 97 which are connected to and form a part of the carriages or support structures 48 by means of intermediate frame members 83. In lifting a load using the shoes, after the carriages 48 have been adjusted to the desired longitudinal positions to fit load 54, the arms 50 are then pivoted downwardly to vertical position, and moved inwardly to insert lift shoes 52 beneath the load. FIG. 5 is a fragmentary view partially in section, taken at the location indicated in FIG. 3, showing a portion of the carriage 48 and arms 50 in the depending position. Included is a brace portion indicated generally by the numeral 90. One of the rollers 92 which operates along the top of I-beam **46*b* is shown in FIG. 5.**

Figure 6:
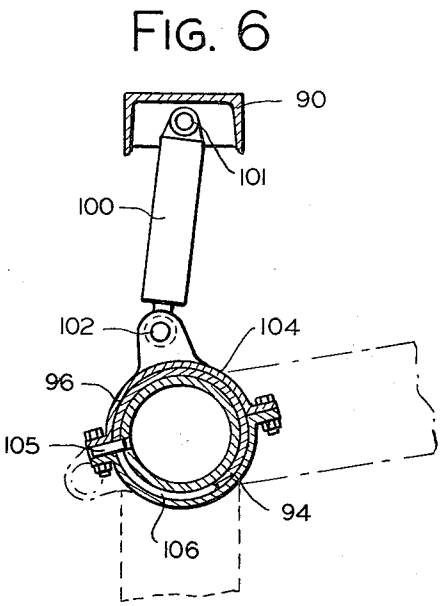
FIG. 6 is a sectional view along line 6 — 6 of FIG. 5.

The structural portion of the carriage 48 includes a fixed transverse tube 94. Within tube 94, which extends across the load lifting device, there is located at each end a telescopic tubular member 96 which is arranged to be moved inwardly and outwardly within tube 94 by means of a remotely controlled linear actuator 98. At the outer end of each tube 96 one of the lift arms 50 is securely affixed to the tube, and in FIG. 5 a single arm 50 is shown in the depending position for lifting load 54. To provide for the specified pivotal movement of arm 50, the tube 96 on which it is mounted is pivoted by means of a linear hydraulic actuator 100 which may be seen in FIG. 6. It is pivotally connected at the top to brace 90 to pivot about an axis 101, while at the bottom it is connected at 102 to a rotation muff 104, which in turn is operatively engaged with inner tube 96 by means of a key 105 which is secured to the muff 104. As shown in FIG. 6, the outer tube 96 has a cutout portion indicated at 106 which extends through an arc of more than 90°, and through which the key 105 projects into a longitudinal slot 107 (see FIG. 6A) in the inner tube 96. With this arrangement, circumferential movement of the muff 104 by means of the actuator 100 causes the key 105 to pivot the tube 96 about its axis, the key 105 moving through the slot or cutout portion 106 in the outer tube 94. Pivotal movement of more than 90° as provided is adequate to enable the necessary pivotal movement of the arm between the maximum up and the maximum down position by arcuate movement of the pivot point 102 which, in turn, is produced by the extension and retraction of actuator 100.

Figure 6A:
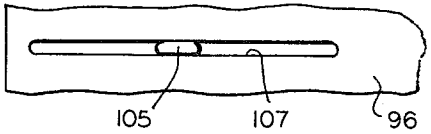
FIG. 6A is a fragmentary view of a portion of the mechanism shown in FIG. 5.

Referring to FIG. 6A, the slot 107 extends longitudinally of the tube 96 to provide for out and in movement of the tube 96 by means of actuator 98 as previously described, independently of and without interference with the pivoting mechanism described in the preceding paragraph. During such out and in movement of the tube 96, the slot 107 moves out and in relative to the key 105.

Figure 8:
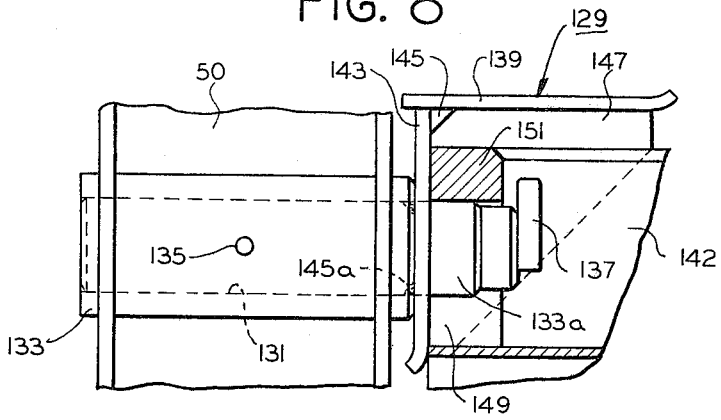
FIG. 8 is an enlarged fragmentary view of one embodiment of the present load engaging and lifting mechanism, illustrating the manner in which it is used to engage and support a load such as a cargo container.

The load handling apparatus disclosed herein is adapted for moving cargo containers which normally have fittings in the upper corners of the sides, including openings extending inwardly for receiving a load engaging member of the lift mechanism. The corner fittings on the container with the openings are utilized by fittings 129, constituting the primary feature of the present invention and shown in detail in FIGS. 8 and 9. The fitting 129 is inserted from the inside in an opening 131 in arm 50. Fitting 129 has a portion 133 which projects through the opening 131 and is secured to the arm 50 in a suitable manner such as by a cross pin at 135 to prevent accidental dislodging of the fitting 129 during use. The inner part of the fitting 129 is provided with an upwardly projecting portion 137 for preventing accidental dislodging of the container in a manner which is explained subsequently. The fitting 129 also includes a top plate portion 139 which engages the top of the container indicated generally in FIG. 8 by the numeral 142. Fitting 129 also has a side guide member 143 which is rigidly secured to top guide portion 139 such as by welding at 145*a* at the outer surface of side member 143 where the pin 133*a* extends through an opening in side guide member 143. At the back of fitting 129 as seen in FIG. 8 is a gusset plate 147, which also has a guiding function, as will be explained, and which is welded to top plate portion 139 and also to side guide member 143. Opening 131 is formed by welding a tubular fitting 133 into a commensurate opening in arm 50, therewith forming proper support for the insertable fitting 129. When fitting 129 is not to be used it can be withdrawn from opening 131, after cross pin 135 has been removed and subsequently inserted from the outside of arm 50 whereby cross pin 135 can be reinserted for safekeeping.

In order to engage fitting 129 in a side opening 149 in container 54, arm 50 is maneuvered to first locate the fitting adjacent the opening 149 in the container in a position in which portion 137 of the fitting is outside opening 149 instead of inside as shown in FIG. 8. Top plate 139 and end gusset 147 are useful in positioning the fitting in such location ready for engagement. For example, if the fitting is reasonably close to the desired position, it is possible to lower the arm 50 until top plate 139 engages the top 142 of the container. Then the arm 50 is moved forwardly until gusset 147 engages the rear surface of the container. This means that portion 137 is directly outside opening 149 and at a low enough position that it will enter the opening. Then arm 50 is moved so that portion 137 enters opening 149, after which arm 50 is raised to move the fitting to the position shown, where the container is prevented from becoming detached from the fitting 129 by portion 137 being at a higher elevation than the lower edge of portion 151 of the container.

When the fittings 129 are being used, it is necessary to pivot the lift shoes 52 at the bottom of the arms 50 out of the way so that they will not damage the side of the container, and this is accomplished in a manner indicated in FIG. 5A in which the shoe 52 is pivoted about axis 161 after withdrawing a pin 163 which normally holds the shoe 52 in a horizontal operating position to allow the shoe to pivot to the position shown in FIG. 5A, after which pin 163 is reinserted in opening 165 to hold shoe 52 in the retracted position.

Figure 7:
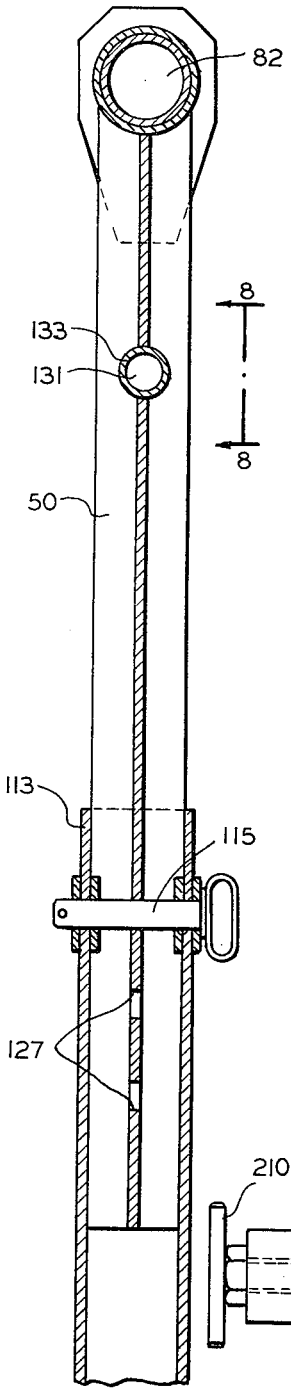
FIG. 7 is a more detailed view in section of one of the lift arms.

FIG. 7, which is partially in section, also shows an adjustable extension for the end of hanger arm 50 which is desirable in some instances. This comprises an outer extension member 113 which surrounds the arm 50 and is secured to it by means of a pin 115 extending through suitable openings in both member 113 and arm 50 to locate the lift shoe 52, which in this case is secured at the bottom of extension member 113. By providing one or more additional openings, as at 127, through the arm 50, for pin 115, it is possible to adjust member 113 and the lift shoe 52 at the bottom thereof to accommodate loads of varying height.

Figure 10:
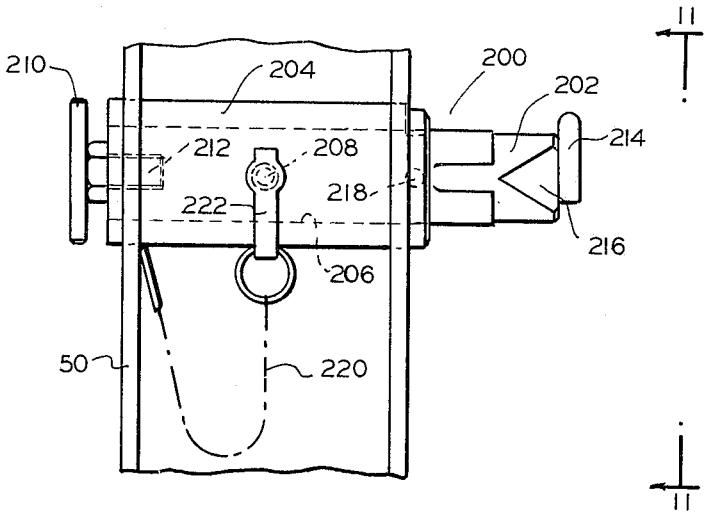
FIG. 10 is an elevational view of the mechanism seen in FIG. 9, showing the mechanism in its nonoperating position.
Figure 9:
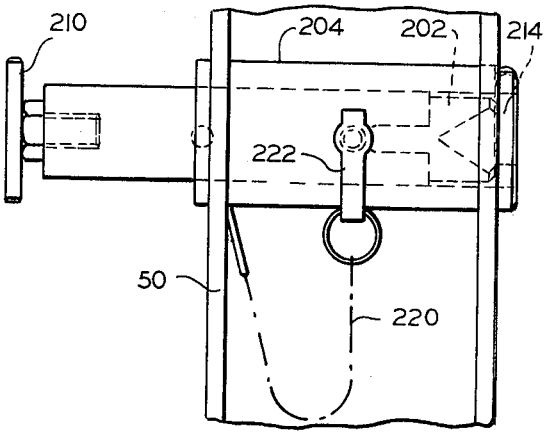
FIG. 9 is an elevational view of a modified form of the present load engaging and lifting mechanism and a fragmentary elevational view of the arm seen in FIG. 7, showing the mechanism in operating position.
Figure 11:
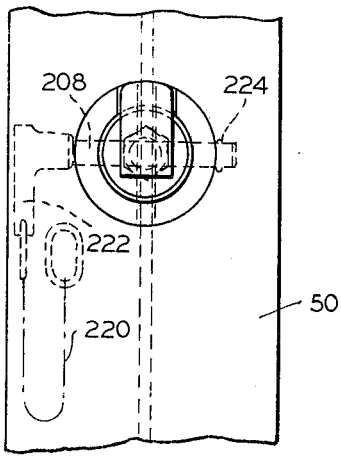
FIG. 11 is an elevational view of the mechanism shown in FIG. 10 as viewed from line 11 — 11 of FIG. 10.

The modified form of the invention illustrated in FIGS. 9, 10 and 11 is similar in some respects to the load engaging and supporting unit illustrated in detail in FIGS. 7 and 8. In the modified form, a pin 202 is slidably disposed in a sleeve 204 rigidly secured in arm 50 and having a center bore 206 extending the full length thereof. Pin 202 extends through bore 206 and is held in place by a cross pin 208 extending through holes in sleeve 204 and pin 202. The pin 202 is prevented from becoming displaced from the sleeve by a crossbar 210 welded to the head of bolt 212 which is threadedly received in a bore in the end of the pin 202. The load engaging end of pin 202 is provided with a finger 214 which is secured rigidly to the end of the pin and functions in the same manner as finger 137 in the embodiment shown in FIG. 8. The forward end of the pin is preferably tapered at 216 in order to facilitate insertion of the pin in the opening of the fixture on the cargo container.

The pin 202 of the modified form of the fitting shown in FIGS. 9, 10 and 11 is retractable in order to prevent it from interfering with the operation of the arm when the shoe shown in FIG. 5A is used to lift a load in place of the fitting. In order to retract pin 202, cross pin 208 is removed from pin 202 and sleeve 204, after which pin 202 is pushed to the left, as viewed in FIG. 10, until hole 218 is in alignment with the hole in sleeve 204 and the extreme outside of finger 214 is flush with sleeve 204 as shown in FIG. 9. Pin 208 is then inserted into the hole in sleeve 204 and hole 218, thus holding pin 202 in its retracted position. In order to assure that pin 208 is available when required and is not accidentally lost or dropped when an adjustment is being made, a chain indicated by numeral 220 and a clip 222 are preferably attached to the pin and to a member on arm 50. Other suitable retaining means may be used instead, if desired. Cross pin 208 may have a C-ring mounted on the free end, as indicated at numeral 224, to retain the pin in the holes in sleeve 204 and pin 202 after the latter pin has been placed in either its extended or retracted position. This is an alternative to the conventional detent of cross pin 208 by two trapped steel balls with a small coil spring in between.

While only two embodiments of the present load engaging and supporting mechanism have been described in detail herein, various changes and modifications may be made without departing from the scope of the invention.

I claim:

1. A fitting adapted for handling cargo containers with fixtures in the upper side corners with openings therein, and being mountable on laterally adjustable arms extending downwardly along opposite sides of the container: said fitting comprising a container engaging member for projecting into one of the openings in the container and being in a normally fixed position with respect to the arm, and a guide means spaced laterally from said member and including top and side plates disposed above and at the side of said member for engaging the top and end of the container for assisting in positioning said member in said one opening upon inward movement of the arm and member, and having an upwardly extending finger disposed at the free end of said member in spaced relation to said top plate for releasably retaining said member in the opening of the respective fixture.

2. A fitting structure as defined in claim 1 in which a vertically positioned abutment plate is disposed in close proximity to said member adjacent the respective arm, and said top and side plates are secured to said abutment plate.

3. A fitting structure as defined in claim 2 in which said member includes a shaft for seating in an opening in a laterally adjustable arm and extending therethrough.

4. A fitting structure as defined in claim 1 in which said member includes a shaft for seating in an opening in a laterally adjustable arm and extending therethrough.

5. A fitting structure as defined in claim 1 in which said member includes an extensible and retractable shaft for extending into operating position in the opening in the respective fixture and for retracting into inoperable position.

6. A fitting structure as defined in claim 5 in which a means is included for retaining said shaft in either of said positions.

7. A fitting structure as defined in claim 5 in which said shaft has a tapered, fixture engaging end to assist in inserting said shaft in the opening of the fixture.

* * * * *